US006293322B1

(12) United States Patent
Wilson-South

(10) Patent No.: US 6,293,322 B1
(45) Date of Patent: Sep. 25, 2001

(54) SINK BASIN POSITIONING AND MOUNTING APPARATUS

(76) Inventor: Michael Wilson-South, 1916 Umalu St., Honolulu, HI (US) 96800

( * ) Notice: Subject to any disclaimer, the term of this patent is extended or adjusted under 35 U.S.C. 154(b) by 0 days.

(21) Appl. No.: 09/376,158

(22) Filed: Aug. 17, 1999

(51) Int. Cl.[7] ..... B27M 3/00

(52) U.S. Cl. ..... 144/372; 33/563; 144/137; 144/144.1; 144/144.51; 409/130

(58) Field of Search ..... 33/197, 562, 563, 33/564, 565, 566; 29/720; 144/136.1, 137, 144.1, 144.51, 135.2, 372; 409/110, 125, 130

(56) References Cited

U.S. PATENT DOCUMENTS 3,540,130 * 11/1970 French ..... 409/130
4,274,459 * 6/1981 Galajda ..... 144/144.51
4,353,672 * 10/1982 Smith ..... 409/130
5,325,899 * 7/1994 Kochling ..... 144/144.1
5,383,503 * 1/1995 Johnson ..... 144/144.51

* cited by examiner

*Primary Examiner*—W Donald Bray
(74) *Attorney, Agent, or Firm*—Michael R. McKenna

(57) ABSTRACT

An apparatus for positioning and mounting sinks to the underside of solid polymer countertops has a framework assembly consisting of a front rail (14) comprising an aligning channel (16), rail assembly brackets (26) and a centering graph (20); side rails (18) comprising template mounting ledges (22, 24) and turn-button attachment means (60); a rear rail (46) comprising mounting ledges (22, 24) and rail assembly brackets (26). A sink positioning/hold-down template (38) comprising a sink positioning opening (42), a clearance opening for faucet hole routing (40), sink hold-down clamp assemblies (44), and notches (50) for positioning permanent sink clamps, is mounted on ledge (22) by means of turn-buttons (60). A sink opening router template (36) comprising a router guide opening for sink (48), an opening for a faucet router template (52), and a faucet router template (32) with router guide openings for a faucet (58), is attached to framework assembly by means of pawl latches (30).

15 Claims, 10 Drawing Sheets

SINK BASIN POSITIONING AND MOUNTING APPARATUS

BACKGROUND OF THE INVENTION

1. Field of the Invention

The invention includes sink basin countertop fabrication. More specifically, the invention includes a method and apparatus to position and mount a sink basin on the underside of a pre-manufactured, solid polymer or polymer-veneered countertop.

2. Background Information

A sink may be thought of as a water basin fixed to a wall or floor, surrounded by a countertop as a level surface, and serviced by both a piped supply of water and a drainpipe. Sink basins mounted from the underneath side of a countertop may be installed in polymer countertops by one of two methods: (i) either by chemical fusion using an epoxy-type adhesive so that the sink basin becomes integral with the countertop; or (it mechanically securing the sink basin to the countertop using mechanical fasteners and sealant. Both of these methods of installation are normally performed in specialized fabrication shops through a highly skilled process.

The highly skilled installation process may involve the following steps: (1) penciling square reference lines at the desired sink basin location on the top surface of a countertop; (2) positioning the sink basin on the countertop and tracing the sink basin perimeter precisely over the reference lines; (3) removing the sink basin and cutting an opening in the countertop as defined by the tracing; (4) turning the countertop over (an operation which often requires two workers); (5) drawing new square reference lines; (6) positioning the sink basin carefully over the cut opening; (7) preparing and attaching a number of sink basin positioning blocks around the sink opening perimeter; (8) removing the penciled lines by solvent or sanding, so as not to blemish the fused sink seam or sealant; (9) applying adhesive or sealant to the sink basin flange; (10) again setting the sink basin carefully in place; and (11) attaching mechanical fasteners such as clamps to secure the sink basin to the countertop.

The above process may take a half-hour longer for a skilled fabricator to install even a small sink basin. Solid polymer basins that are integrally mounted into a countertop made of a particle board substrate with a veneered polymer overlay may require the additional step of routing away the substrate material below the veneer surface to provide a polymer-to-polymer joint. This step is very precise and requires a fabricator of the highest skill level. This is one reason why the use of integrally mounted polymer sinks in veneered polymer counters is limited in the conventional art. In addition to these problems, there are many opportunities for error in every step of the current methodology of under mounting sink basins. Mitigating these potential for errors requires the employment of only skilled, expensive journeypersons in these tasks.

In more advanced fabrication shops, plywood outline templates are often used to locate and trace the sink basin perimeter to be cut, eliminating the need to draw square reference lines. In some instances, plywood router templates are used in cutting the opening over which the sink basin is then mounted. Although the use of these templates reduces errors and process time somewhat, the overall task still requires a highly skilled worker and a good deal of time. For instance, although a router template to cut a sink opening may facilitate a smooth and properly shaped opening, the router template will not obviate the need for tracing the sink basin, for fabricating and attaching sink basin positioning blocks, and for removing the tracing lines.

One of the more time consuming elements of the current methodology involves the process of clamping integrally mounted basins to a countertop work piece. After having reached that stage in the overall process outlined above at which the sink basin is ready to be mounted, a plywood clamping template is positioned below the countertop by a worker such that the plywood overlaps the sink basin opening. The worker below then passes an adjustable clamping device through a prepared hole in the plywood template, then through the sink basin opening, and also through the sink basin drain hole, whereby the sink basin is clamped firmly to the countertop by a second worker positioned above the countertop. This operation often requires two workers to both clamp and remove the plywood template. Also, this method of mounting basins requires a special topless workbench that permits access below to apply and remove the plywood template and clamping device. Since this workbench is not always the best work surface for other types of operations, additional time and material expense are required to change bench configurations for different shop functions.

Collectively, these conventional methods represent the fabrication industry's "best practice", as recommended by the various sink basin manufacturers, yet they do not meet the need for a fast, efficient, and error-free method to (i) accurately locate and cut a sink basin opening and (ii) to mount a sink basin into a countertop.

DETAILED DESCRIPTION OF THE INVENTION

The invention includes a method and an apparatus to quickly and accurately align a sink basin opening router template and a basin positioning template to the underside of a countertop workpiece using attached basin hold-down clamps. With this arrangement, a basin opening can be precisely machined into the countertop to allow a sink basin to be mounted precisely over the opening in much less time than by conventional methods.

Figure 1:
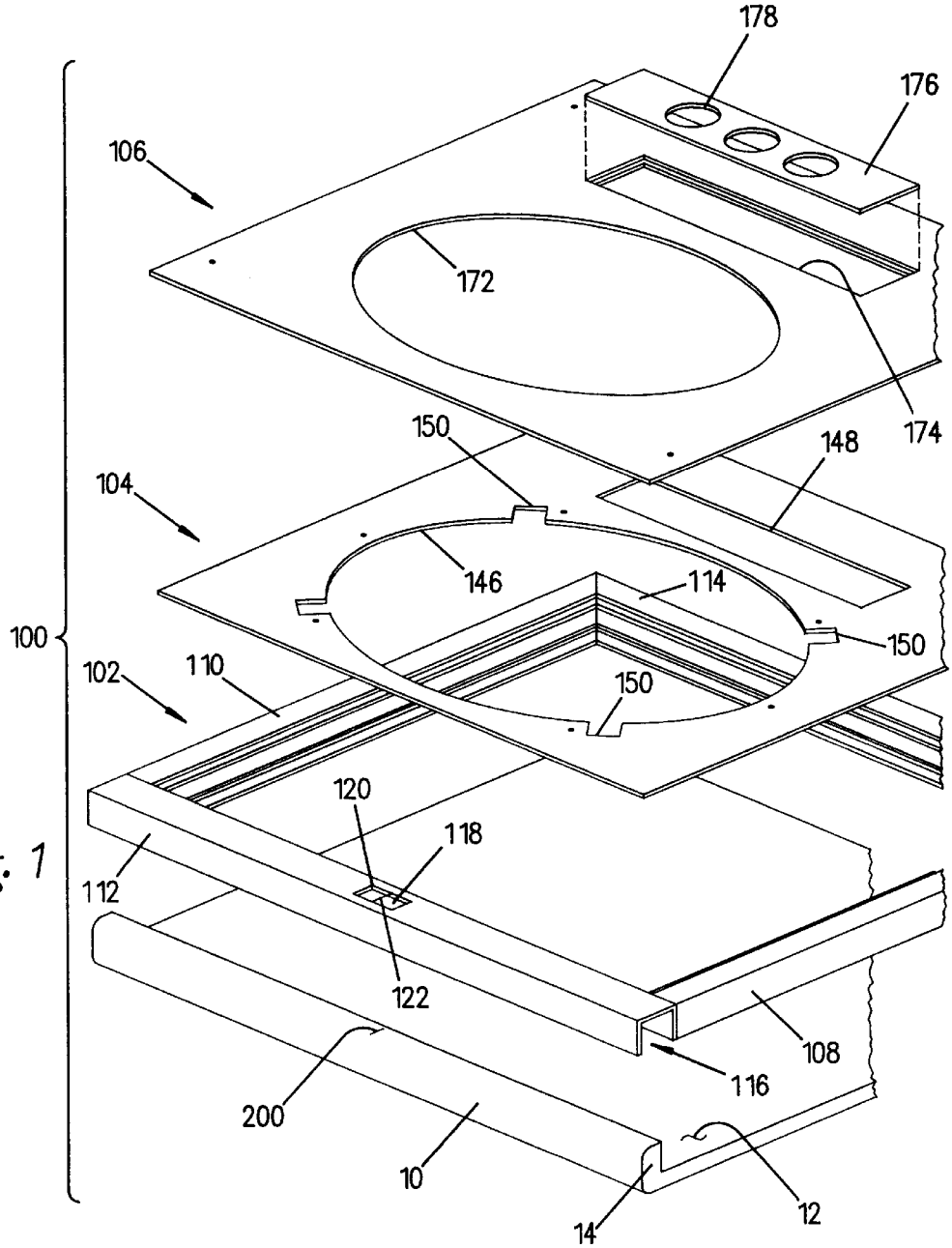
FIG. 1 is an exploded, isometric view of assembly 100 of the invention.

FIG. 1 is an exploded, isometric view of assembly 100 of the invention. Also shown is countertop 10 in an upside down position such that underneath side 12 is exposed to be worked upon. Countertop 10 may be a pre-manufactured, solid polymer or polymer-veneered countertop. Included with assembly 100 may be framework 102, positioning template 104, and routing template 106. When positioning template 104 and routing template 106 are assembled into framework 102, the collective as assembly 100 may be secured to underneath side 12 of countertop 10 so that countertop 10 may be worked upon.

Framework 102 may include side rail 108 and side rail 110, each disposed between front rail 112 and rear rail 114. The material of each rail may include metal, plastic, and wood, either individually or in a composite material. In one embodiment, rails 108, 110, 112, and 114 are made from extruded aluminum.

As seen in FIG. 1, front rail 112 may include channel 116, centering graph 118, and orifice 120. Where countertop 10 includes overhang 14, channel 116 may be sized to fit over and around overhang 14. This relationship may be seen in FIG. 10.

Centering graph 118 may be thought of as a clear window that aids in aligning assembly 100 to countertop 10. Towards this end, centering graph 118 may be made of a clear plastic material having fiducial line 122 scored therein as shown. Centering graph 118 may be fixed to the interior of channel 116 by adhesive so that fiducial line 122 is aligned with a midpoint of orifice 120.

Figure 2:
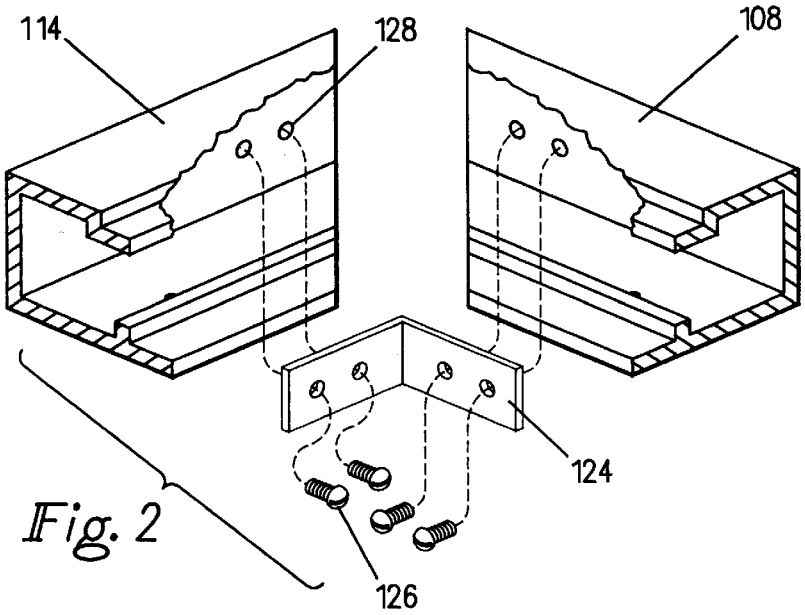
FIG. 2 illustrates a technique to fix the rails of framework 102 together.

FIG. 2 illustrates a technique to fix the rails of framework 102 together. Further included with framework 102 may be bracket 124 and screws 126. On abutting an end of each of side rail 108 and rear rail 114, bracket 124 may be placed against the interior of these rails so as to align with holes 128. Bracket 124 may be secured to side rail 108 and rear rail 114 by screws 126. Front rail 112 similarly may be fixed to side rail 108 and side rail 110.

Figure 3:
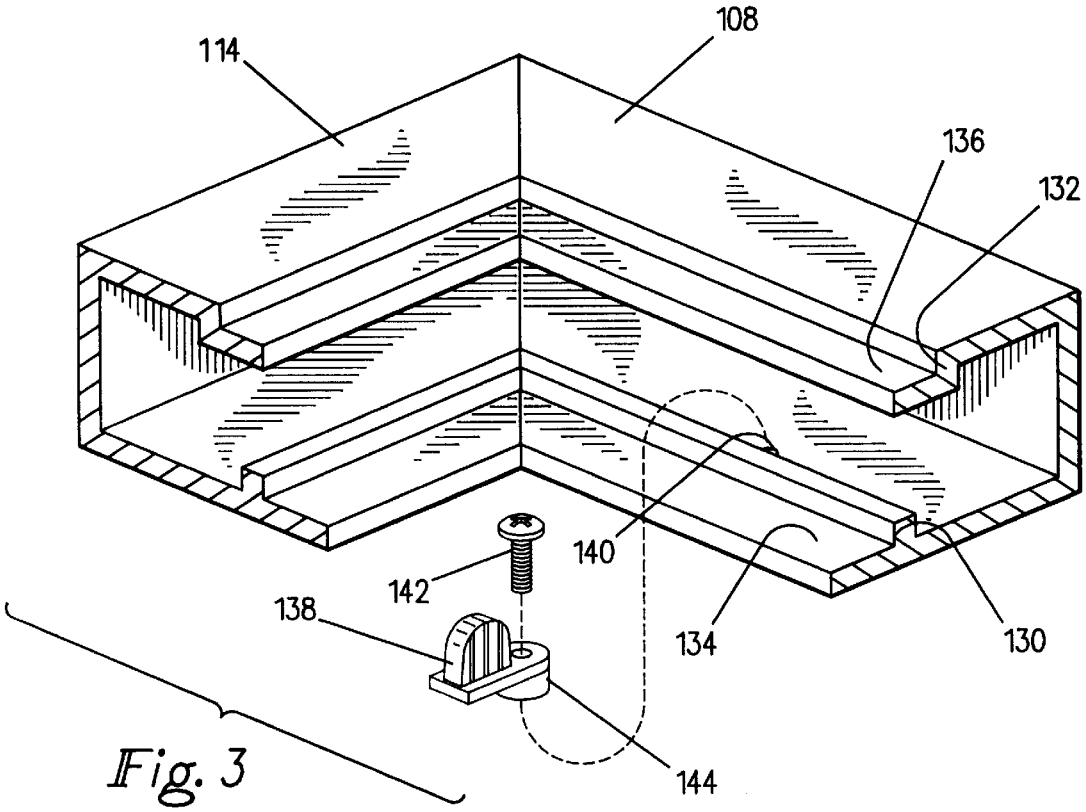
FIG. 3 illustrates a positioning of turn button 138.

As seen in FIG. 3, framework 102 may include ridge 130 and jog 132, each of which may be formed near an interior perimeter of framework 102 so as to create a ledge. For example, ridge 130 may form ledge 134 where ledge 134 may be used to support positioning template 104. Additionally, jog 132 may form ledge 136 where ledge 136 may be used to support routing template 106.

To hold positioning template 104 of FIG. 1 into framework 102, framework 102 may also include turn button 138 (FIG. 3). FIG. 3 illustrates a positioning of turn button 138. As seen in FIG. 3, turn button 138 may be secured to hole 140 of side rail 108 by screw 142. When secured into position behind ridge 130, turn button 138 may be adapted to rotate about standoff 144. Similar to a painting held in a frame, framework 102 may include four turn buttons 138 disbursed about framework 102. Framework 102 may vary in overall outside dimensions to accommodate templates of various sizes which, in turn, may accommodate sink basins of various shapes and sizes.

As noted above, FIG. 1 includes an isometric view of positioning template 104. Positioning template 104 may be thought of as a pattern that may be used to accurately guide a sink basin into position within a routed countertop 10. In one embodiment, positioning template 104 may be made from a ⅛ inch (") thick aluminum sheet.

Positioning template 104 may include opening 146 to aid in positioning a sink basin into its position in countertop 10. Positioning template 104 may also include clearance opening 148 and notches 150. Clearance opening 148 may provide access to the faucet locations within countertop 10. Notches 150 may be spaced around opening 146 to allow for optional attachment of permanent sink basin clamps (not shown) to underneath side 12 of countertop 10.

Figure 14:
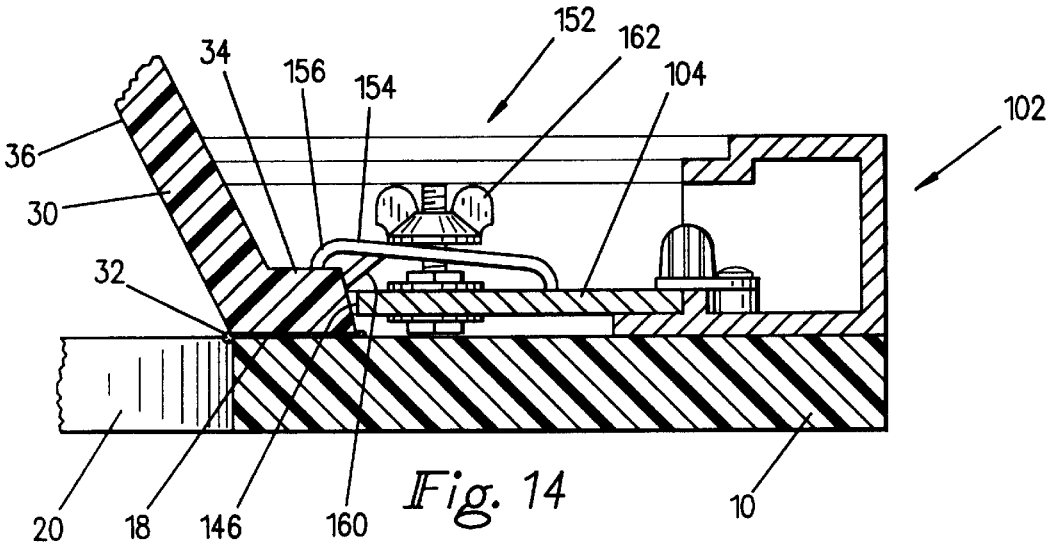
FIG. 14 illustrates basin 30 being secured to countertop with adhesive 32.

In addition to opening 146 of positioning template 104 being adapted to locate a sink basin into its position in countertop 10, positioning template 104 may also include clamps 152. As seen in FIG. 14, clamps 152 may aid in temporarily securing basin 30 to counter top 10.

Figure 4:
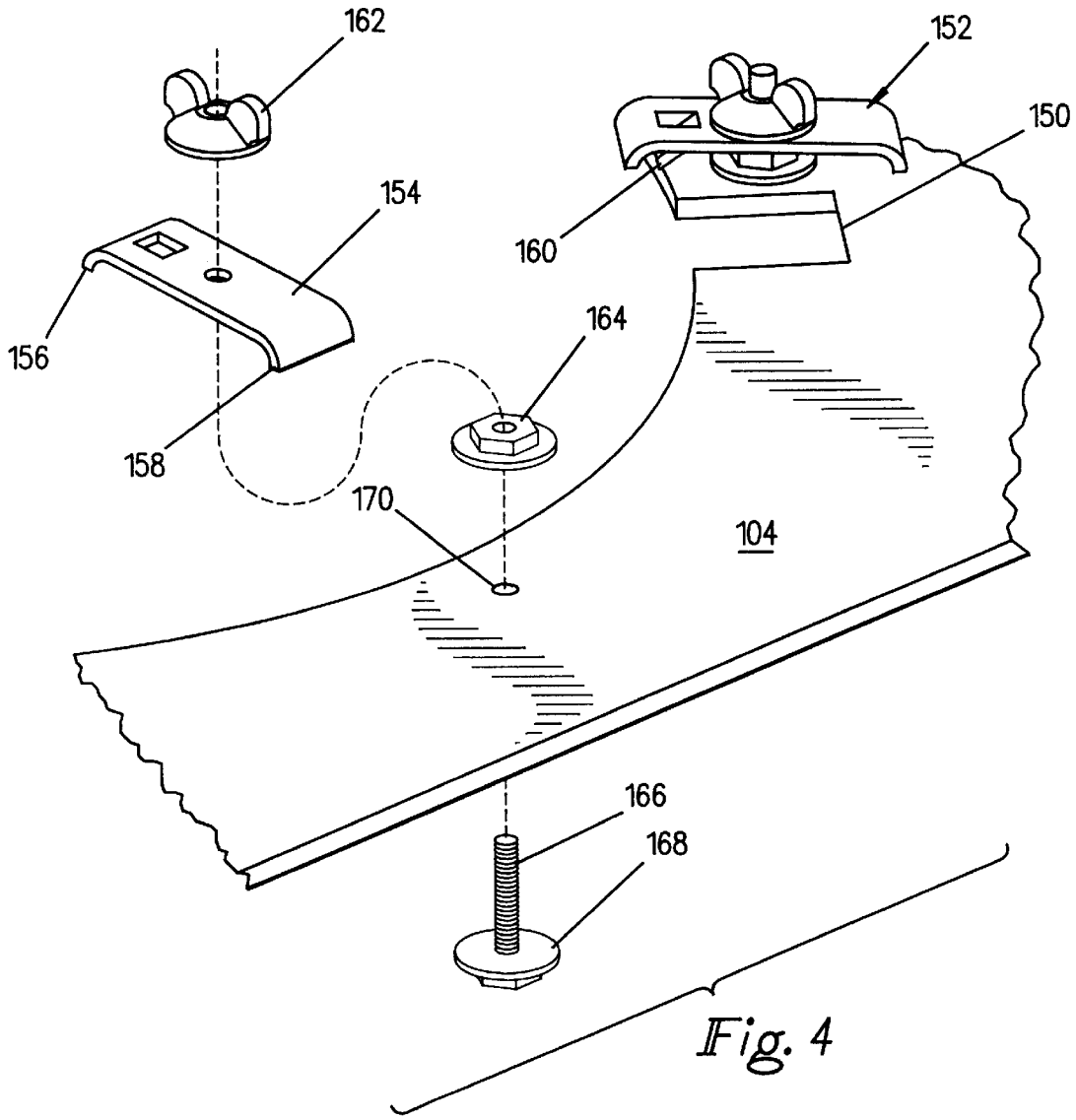
FIG. 4 is an isometric view of clamps 152.

FIG. 4 is an isometric view of clamps 152. Each clamp 152 may include lever 154 having prong 156, prong 158, and bar 160. Clamps 152 may also include wing nut 162, nut 164, bolt 166, and washer 168. Bolt 166 having washer 168 may be placed through hole 170 and be held in place by nut 164. Nut 164 may be a hex nut having a washer fixed against a side of nut 164. Lever 154 may then be placed about bolt 166 and be held loosely in place by wing nut 162. In one embodiment, assembly 100 may include four clamps 152.

Figure 5:
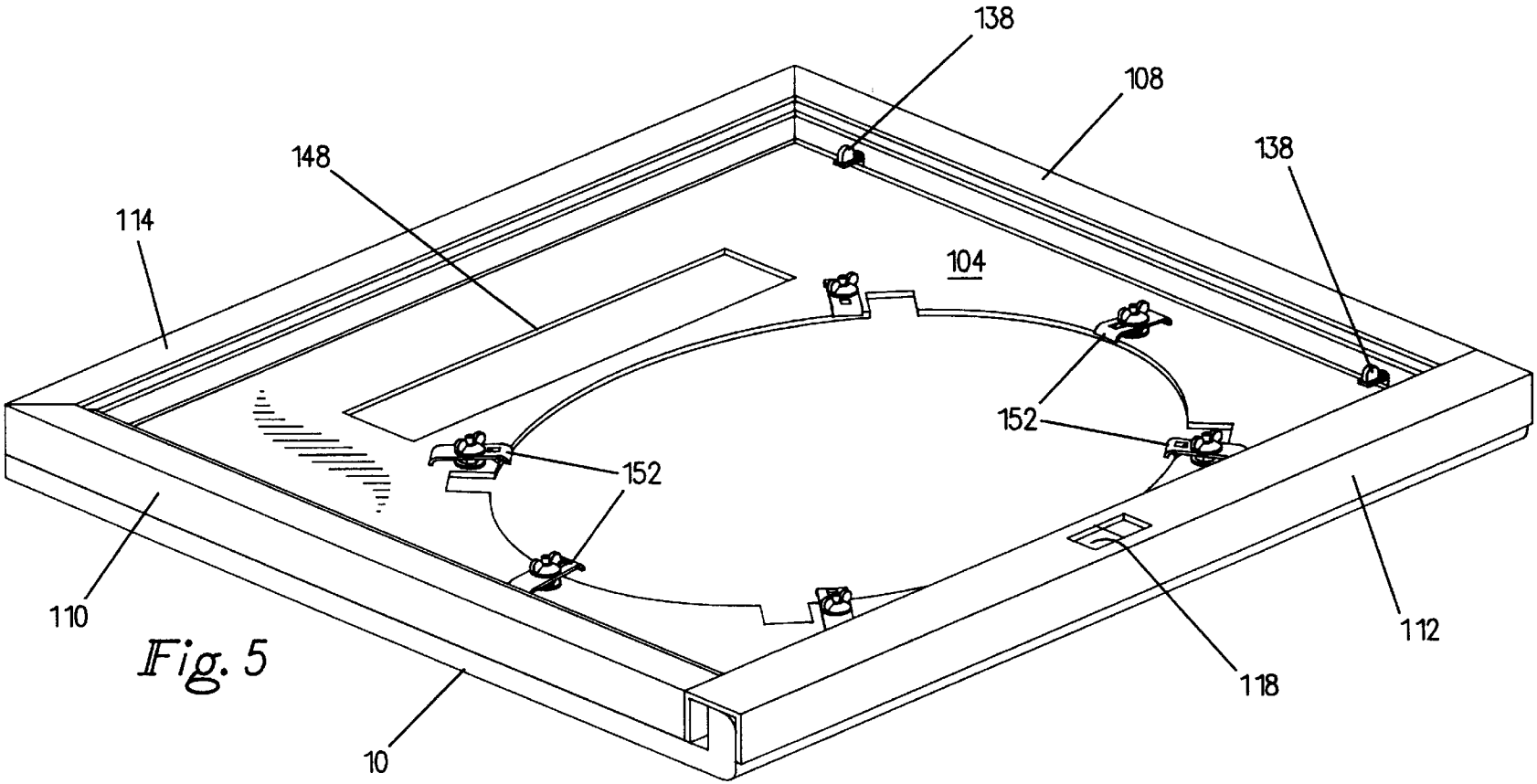
FIG. 5 illustrates positioning template 104 as secured within framework 102.

FIG. 5 illustrates positioning template 104 as secured within framework 102. This may be accomplished by lowering positioning template 104 into framework 102 until positioning template 104 engages ledge 134 (FIG. 3). With positioning template 104 so located, turn buttons 138 may be rotated so as to extend over positioning template 104, thereby securing positioning template 104 into position.

As noted above, FIG. 1 includes an isometric view of routing template 106. Routing template 106 may be thought of as a pattern that may be used to accurately guide a router cutting bit in and about countertop 10 to form an access hole to a sink basin. In one embodiment, routing template 106 may be made from a ⅛ inch (") thick aluminum sheet.

Routing template 106 may include opening 172 to aid in guiding a router cutting bit in and about countertop 10. Routing template 106 may also include faucet template 176 and template opening 176. Faucet template 176 may be thought of as a pattern that may be used to accurately guide a router cutting bit in and about countertop 10 to form one or more access holes for a water flow regulator such as a faucet. In one embodiment, faucet template 176 may include three holes 178 for this purpose. Faucet template 176 may be located within template opening 174 as discussed below.

Figure 7:
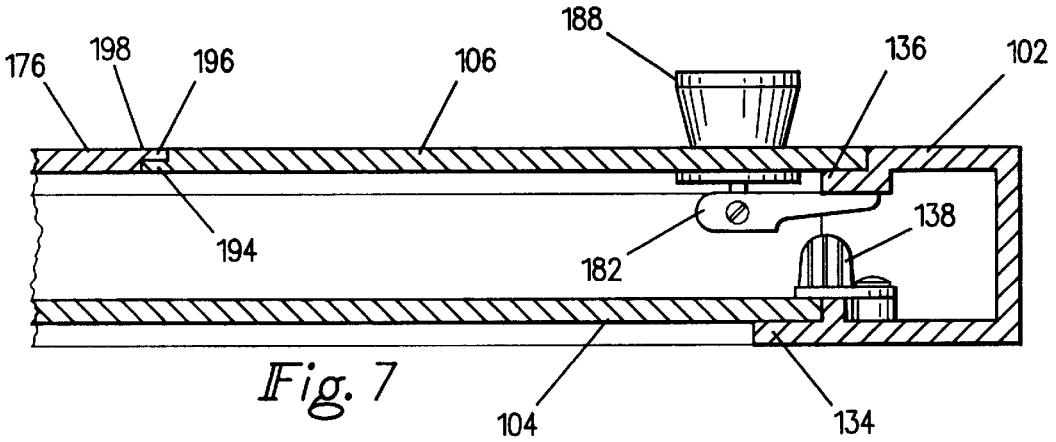
FIG. 7 illustrates a side sectional view of routing template 106 as secured within framework 102.

In addition to opening 172 of routing template 106 being adapted to guide a router cutting bit in and about countertop 10, routing template 106 may also include pawl latches 180. As seen in FIG. 7, pawl latches 180 may aid in securing routing template 106 to framework 102.

Figure 6:
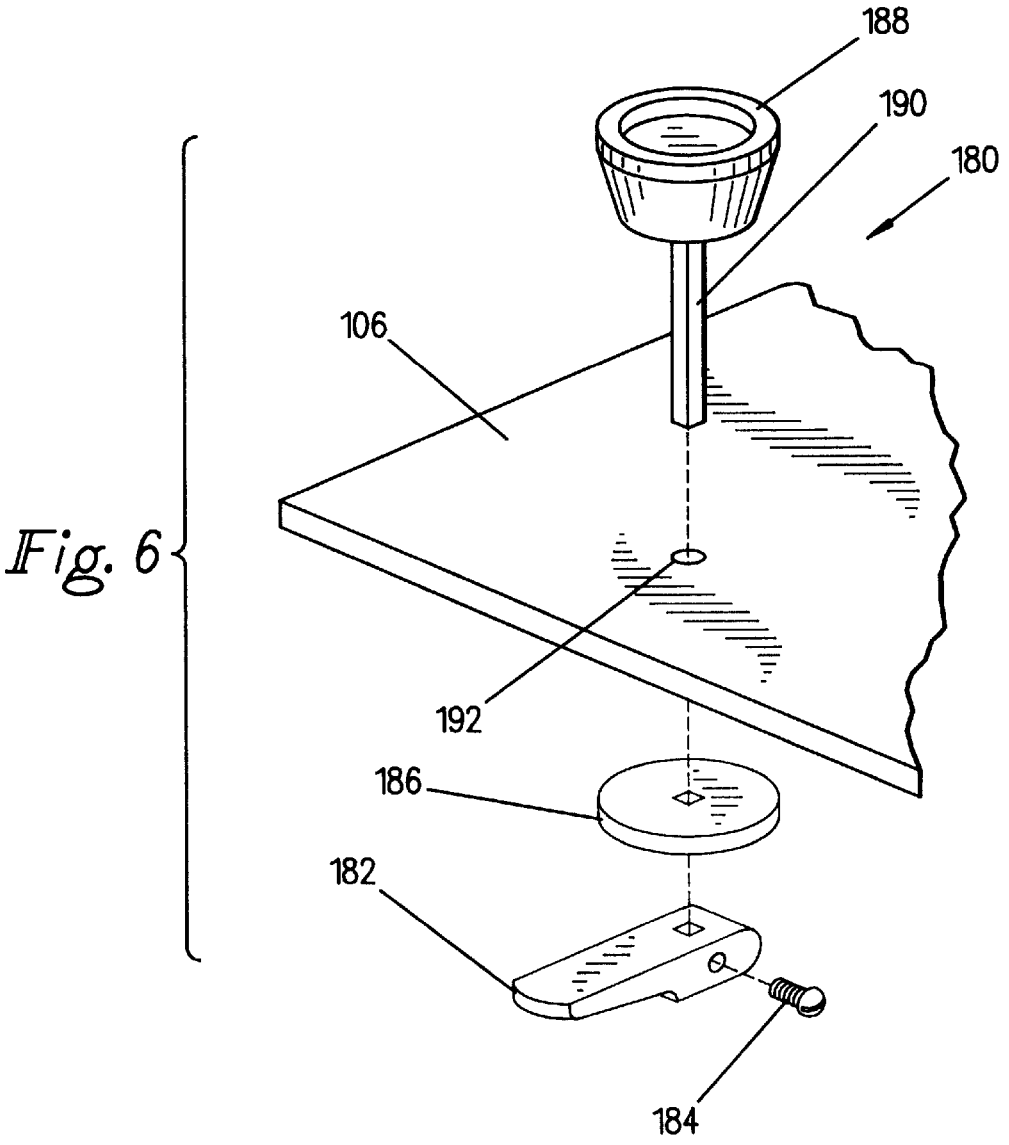
FIG. 6 is an isometric view of pawl latches 180 to be installed in routing template 106.

FIG. 6 is an isometric view of pawl latches 180 to be installed in routing template 106. Each pawl latch 180 may include jaw 182, screw 184, washer 186, and knob 188 having post 190 disposed therein. Post 190 may be placed through hole 192, washer 186, and jaw 182 and be held in place by screw 184.

FIG. 7 illustrates a side sectional view of routing template 106 as secured within framework 102. This may be accomplished by lowering routing template 106 into framework 102 until routing template 106 engages ledge 136 (FIG. 3). With routing template 106 so located, pawl latches 180 may be installed as discussed in connection with FIG. 7, thereby securing routing template 106 into position. Knobs 188 may provide a convenient grip by which to manipulate assembly 100. In one embodiment, assembly 100 may include four pawl latches 180.

FIG. 7 also shows faucet template 176 installed into opening 174. To accomplish this, the perimeter of opening 174 of routing template 106 may define lip 194 and rebate 196 and the perimeter of faucet template 176 may define lip 198. Lip 198 may be mated to lip 194 at rebate 196 and secured.

Figure 8:
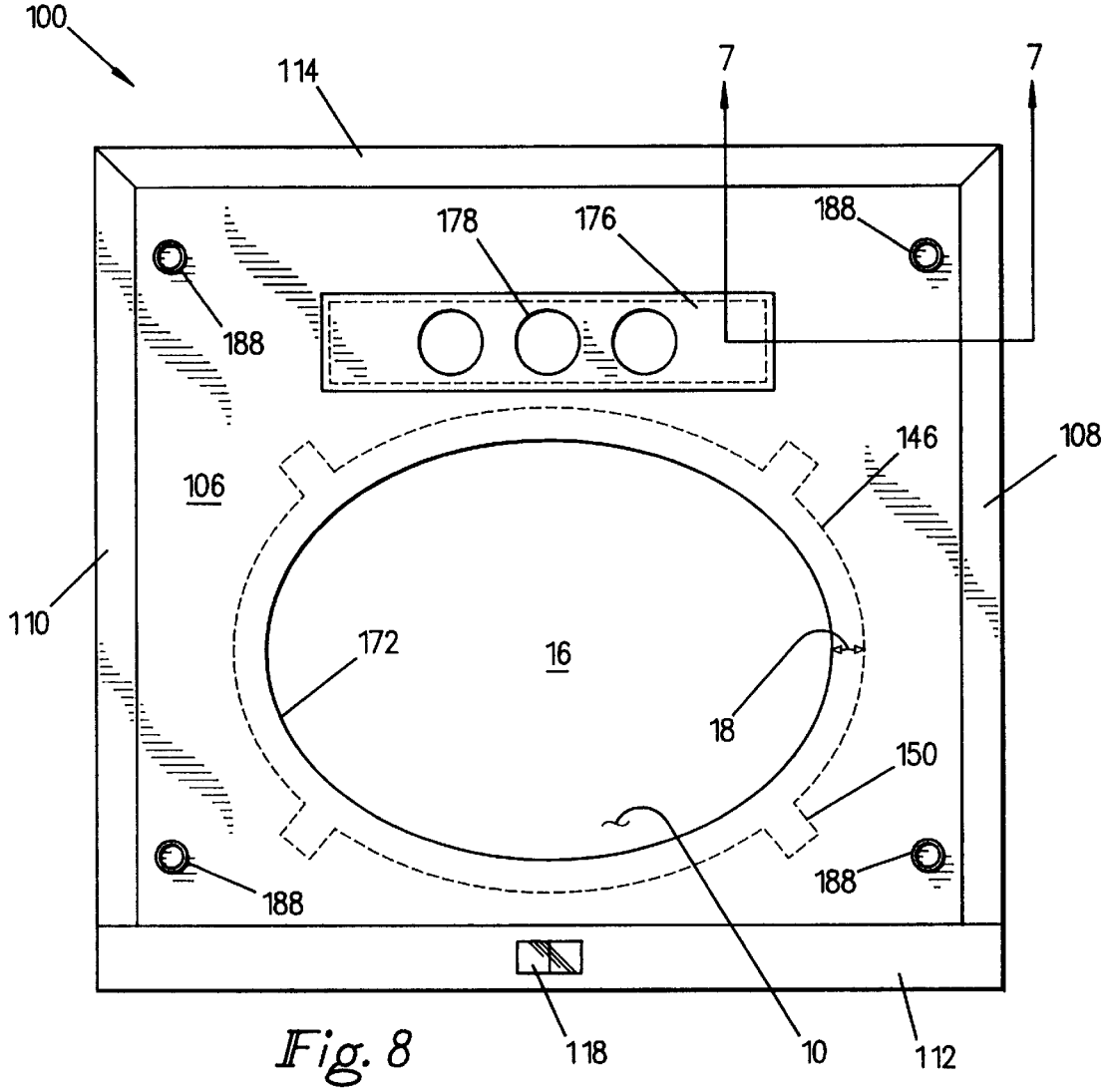
FIG. 8 illustrates the positional relationship between opening 172 of routing template 106 and opening 146 (shown in phantom) of positioning template 104.

FIG. 8 illustrates the positional relationship between opening 172 of routing template 106 and opening 146 (shown in phantom) of positioning template 104. Removing area 16 from countertop 10 by tracing opening 172 with a router bit may leave behind area 18 to mount a sink basin.

From the description above, a number of advantages of the invention become evident:

(a) Working from only one side of a countertop workpiece, the apparatus allows for the precise installation of any number of basin models, types, and sizes.

(b) By using the apparatus, a shop or field worker of modest skill level can precisely install a basin in a counter.

(c) By simultaneously positioning a basin opening template and a basin positioning/hold-down template over a desired centerline mark on a countertop workpiece, the potential for error in installing a basin is reduced.

(d) By allowing for the use of various matched sets of templates in a single framework device, the need for more than a few sizes of framework to accommodate a large number of basin sizes and types is eliminated.

(e) By using the attached basin hold-down clamps, the basin is firmly attached to the countertop in a quicker, more positive manner than by conventional means.

(f) The use of mounting ledges and pawl latches allows for the quick exchange of various templates for different basins.

(g) The basin positioning opening provides the perfect alignment of a basin over a corresponding basin opening, thus eliminating the need for fabricating or installing positioning blocks around a basin flange.

Figure 9:
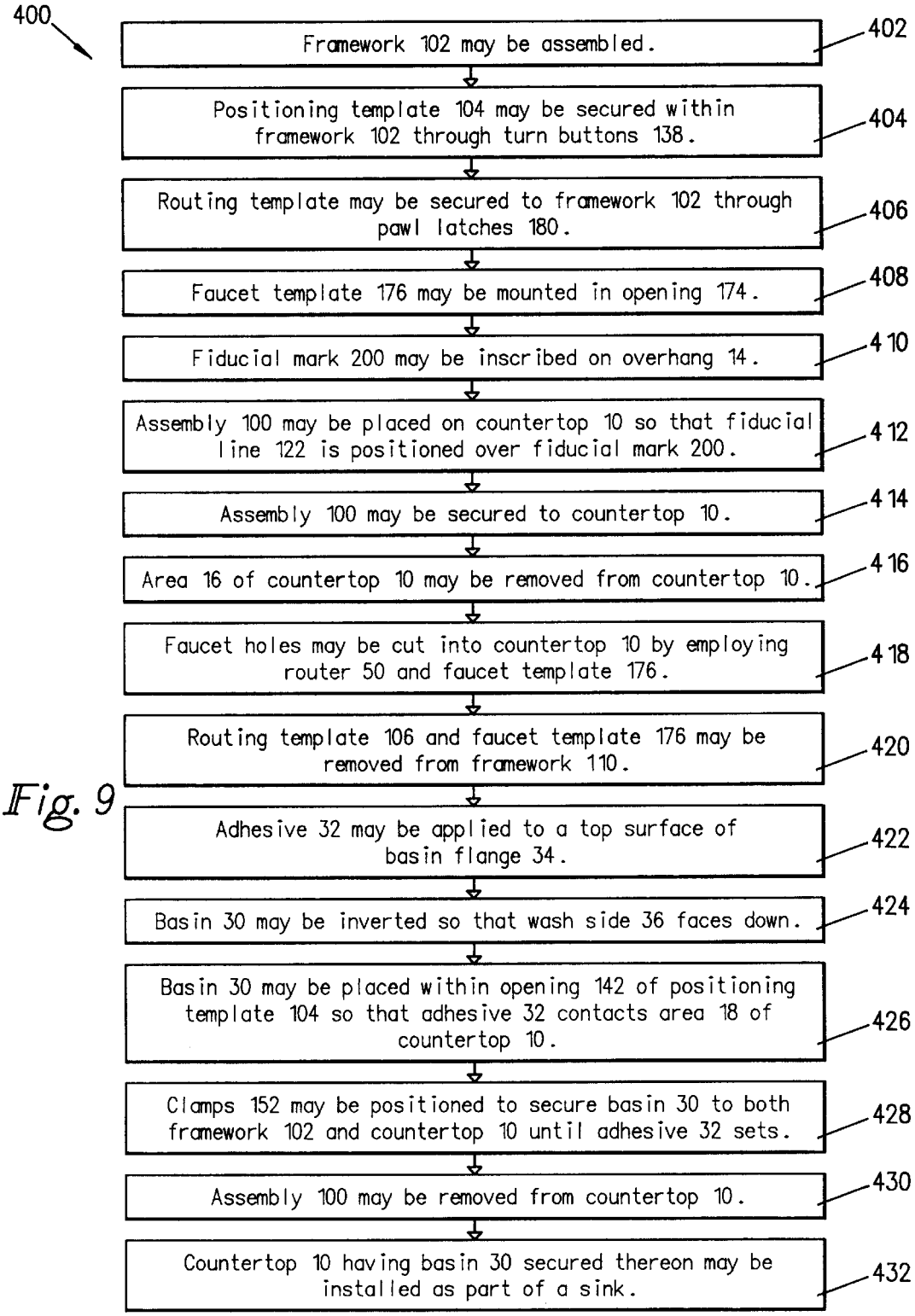
FIG. 9 illustrates method 400 of the invention.

FIG. 9 illustrates method 400 of the invention. At step 402, framework 102 may be assembled. At step 404, positioning template 104 may be secured within framework 102 through turn buttons 138. At step 406, routing template may be secured to framework 102 through pawl latches 180. Faucet template 176 may then be mounted in opening 174 at step 408 such as through lip 194, rebate 196, and lip 198.

At step 410, fiducial mark 200 (FIG. 1) may be inscribed on overhand 14 so as not to be visible when countertop 10 is installed as part of a sink. Using fiducial line 122 of centering graph 188, assembly 100 may be placed on countertop 10 so that fiducual line 122 is positioned over fiducual mark 200 at step 412.

Figure 10:
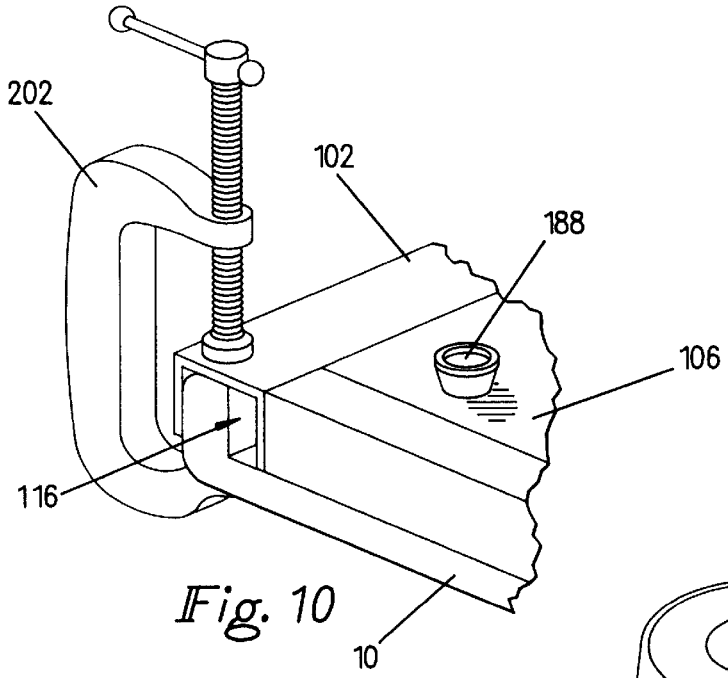
FIG. 10 illustrates one technique to secure assembly 100 to countertop 10.

At step 414, assembly 100 may be secured to countertop 10. FIG. 10 illustrates one technique to secure assembly 100 to countertop 10. As shown in FIG. 10, "C" clamps 202 may be placed along framework 102, about framework 102 and countertop 10, and tightened down.

Figure 11:
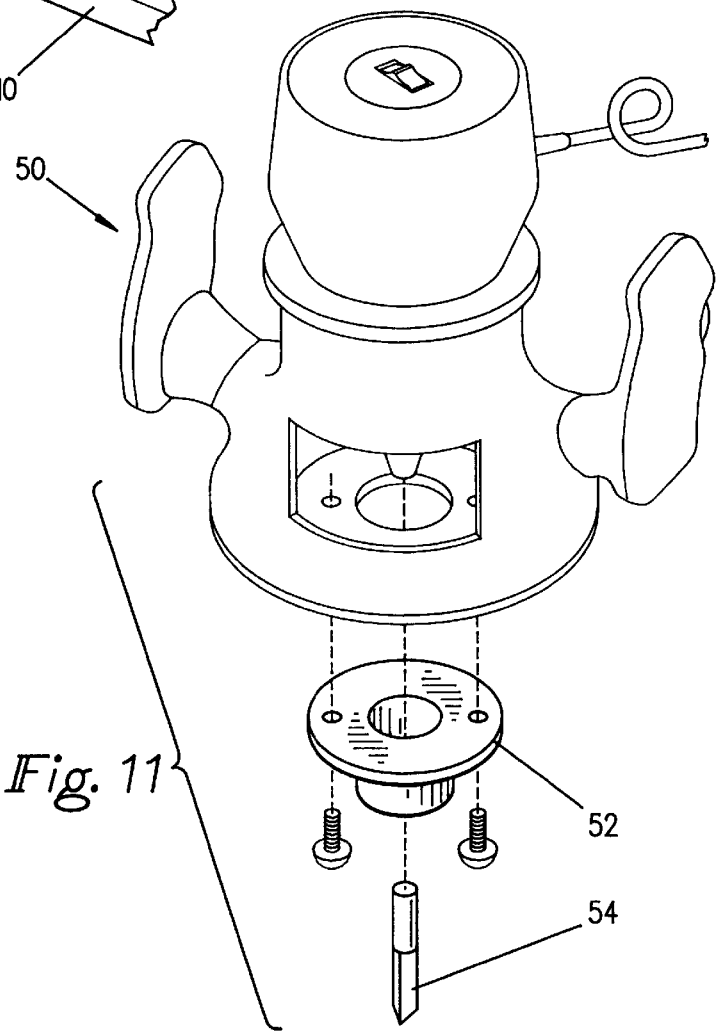
FIG. 11 illustrates router 50.
Figure 12:
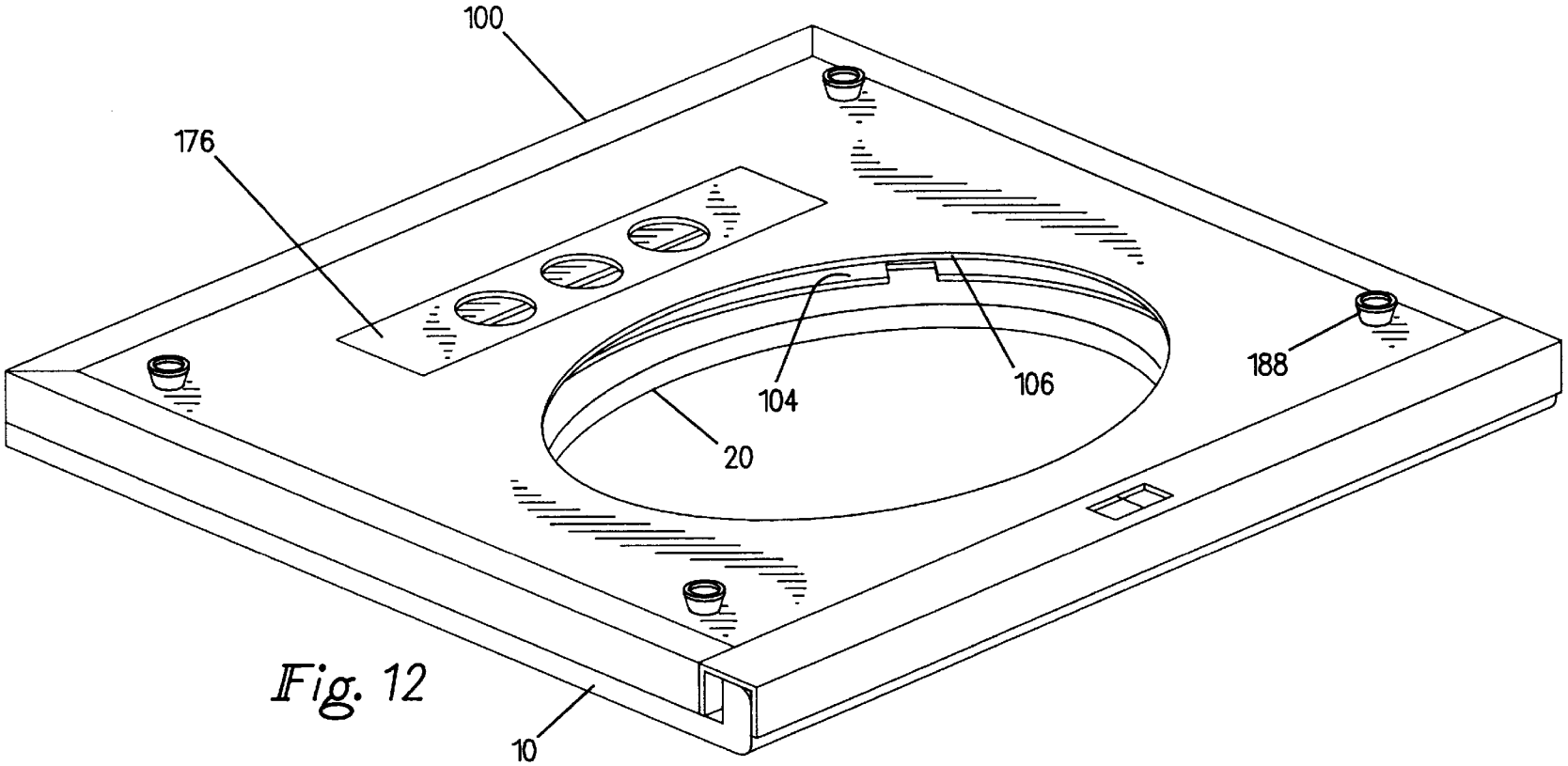
FIG. 12 illustrates assembly 100 disposed above basin opening 20 of countertop 10.

As step 416, area 16 of countertop 10 may be removed from countertop 10. This may be achieved by inserting a cutting bit though area 16 and guiding the cutting bit about opening 172 of routing template 106. The cutting bit may be driven by a commercially available router, such as router 50 of FIG. 11 having router guide bushing 52 and cutting bit 54. At step 418, faucet holes may be cut into countertop 10 by employing router 50 and faucet template 176. Removing area 16 forms basin opening 20. FIG. 12 illustrates assembly 100 disposed above basin opening 20 of countertop 10.

Figure 13:
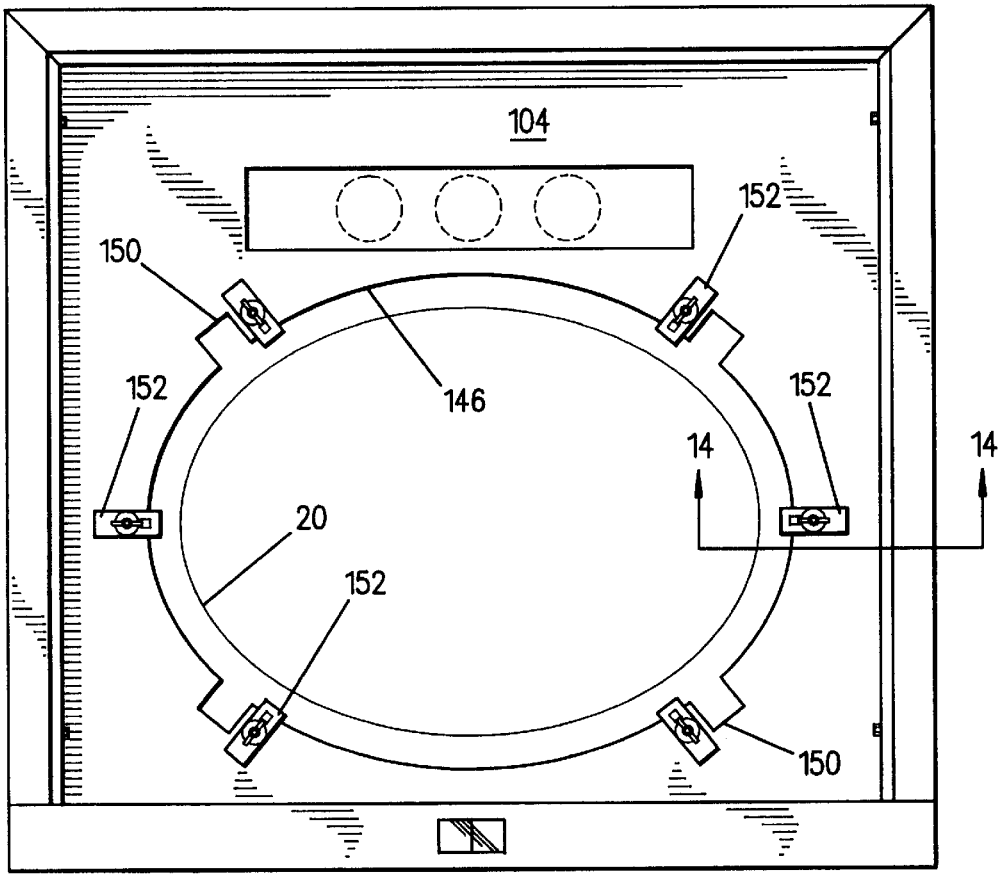
FIG. 13 illustrates a revealed positioning template 104 after step 420.

At step 420, routing template 106 and faucet template 176 may be removed from framework 110. FIG. 13 illustrates a revealed positioning template 104 after step 420. At step 422, adhesive 32 (FIG. 14) may be applied to a top surface of basin flange 34. Adhesive 32 may be an adhesive that is recommended by a sink basin manufacturer. At step 424, basin 30 may be inverted so that wash side 36 faces down. At step 426, basin 30 may be placed within opening 142 of positioning template 104 so that adhesive 32 contacts area 18 of countertop 10. Positioning template 104 may align basin 30 precisely over basin opening 20.

At step 428, clamps 152 may be positioned to secure basin 30 to both framework 102 and countertop 10 until adhesive 32 sets. As shown in FIG. 14, prong 156 and bar 160 of lever 154 may contact basin flange 34 while prong 158 of lever 154 contacts positioning template 104. Tightening down wing nuts 162 may compress lever 154 against both basin 30 and positioning template 104. At step 430, assembly 100 may be removed from countertop 10. At step 432, countertop 10 having basin 30 secured thereon may be installed as part of a sink.

An alternate to securing basin 30 to countertop 10 via adhesive 32 may be to secure basin 30 to countertop 10 with permanent clamps (not shown) as attached to countertop 10 through notches 150. A sink clamping assembly may include of a number of stretchable straps attached to hooks placed around the perimeter of a positioning ring. The sink clamping assembly may also include a cap assembly inserted in a sink basin drain opening.

Accordingly, it may be seen that the apparatus of this invention can be used by a worker of average skill to precisely and accurately locate a basin opening template and a basin position/hold-down template over a pre-marked centerline on a countertop workpiece, such that a precise basin opening can be cut therein, and thereafter a basin mounted securely and precisely over said opening. Additional advantages for the apparatus are that

- it permits the use of various matched templates for various basin types and configurations;
- it allows a basin to be precisely installed in a counter in much less time than by conventional methods;
- the simple design of the framework and templates allows for easy storage and maintenance;
- it provides a means of installation for solid polymer basins into veneered polymer countertops which is less complex than the current method; and
- it provides a much easier means of clamping a basin to a countertop than do current methods.

The invention works to facilitate the installation of basins into countertops by through a framework device. This framework device may accommodate any number of matched sets of basin opening router templates and basin positioning and clamping templates so as to allow the installation of any number of different basin makes, models, or sizes. In general, the invention works to present many conditions and circumstances that are particularly favorable to success. For example, the invention permits a worker to precisely locate a basin opening on a countertop without having to draw square reference lines and with minimum handling of the basin itself. Also, faucet fixture hole of various types may be routed into the countertop at the same time the basin opening is being cut.

By employing the invention to install a basin in a countertop, there may be no need to turn the countertop over, to trace the basin perimeter on the countertop, or to clean off reference and basin perimeter lines. The risk of blemishing the sealant or seam from the reference lines is minimized. Moreover, there is no need to attach basin positioning blocks to the countertop or to use a plywood clamping template.

Since the application of the invention is straight forward, a highly skilled journeyman worker is not required to employ the invention. Further, the conventional need for two workers to set the clamps has been eliminated by the invention. Here, the inventive method and apparatus is easily operable by one worker in either a shop or field environment.

The invention has other advantages as well. For example, the invention allows a worker to simultaneously position a basin router template and a basin positioning template on a countertop without the need for special bench worktables or a shop environment. The invention permits routing a basin opening, and thereafter, attaching a basin over the opening through hold-down clamps. Importantly, the same framework device with corresponding matched sets of basin opening and positioning templates may be used to install any number of different basin makes and models in a countertop.

The time needed to accurately locate a basin opening in a countertop, form the opening, and mount a basin over the opening has been significantly reduced over conventional techniques. One reason for this is that the invention easily permits a lessskilled worker to integrally install a solid polymer basin in veneer polymer countertops. Moreover, the invention allows basin manufacturers to provide to their customers simple instructions to install their basin products.

The exemplary embodiments described herein are provided merely to illustrate the principles of the invention and should not be construed as limiting the scope of the subject matter of the terms of the claimed invention. For example, the apparatus may have other shapes and sizes, and be fabricated from other materials, or have alternate sink clamping devices. The principles of the invention may be applied toward a wide range of systems to achieve the advantages described herein and to achieve other advantages or to satisfy other objectives, as well.

What is claimed is:

1. A sink basin positioning and mounting apparatus, comprising:

a framework;

a positioning template disposable within the framework; and a routing template disposable within the framework.

2. The apparatus of claim 1, wherein the framework includes two side rails disposed between a front rail and a rear rail, wherein the front rail includes a centering graph.

3. The apparatus of claim 2, wherein the centering graph is made of a clear plastic material having a fiducial line disposed therein.

4. The apparatus of claim 1, further comprising:

at least one turn button disposed in operative association with the framework, wherein the positioning template is secured within the framework by the at least one turn button.

5. The apparatus of claim 1, wherein the positioning template includes a basin opening and at least one of a plurality of notches, a faucet clearance opening, and a plurality of clamps.

6. The apparatus of claim 1, wherein the routing template includes a countertop opening, at least one of a faucet template, and a plurality of pawl latches.

7. The apparatus of claim 1, wherein the positioning template includes a basin opening, a faucet clearance opening, and a plurality of clamps, and wherein the routing template includes a countertop opening, a faucet template, and a plurality of pawl latches.

8. A system to secure a basin to a countertop, the system comprising:

a sink basin positioning and mounting apparatus having a framework, a routing template disposable within the framework, and a positioning template disposable within the framework at a position that is adapted to be between the routing template and the countertop, wherein the positioning template includes means for securing the basin to a countertop.

9. The system of claim 8, wherein the means for securing include at least one clamp having a lever, the lever having a bar and two opposing prongs.

10. The system of claim 8, further comprising:

the sink basin positioning and mounting apparatus coupled to the countertop and the basin, wherein the basin is further fixed to the countertop by adhesive.

11. A method to position and mount a sink basin to a countertop, the method comprising:

disposing a positioning template and a routing template within a framework of an apparatus;

disposing upwardly the underside of a countertop;

positioning the apparatus the underside of the countertop;

removing a portion of the countertop by employing the routing template;

removing the routing template from the framework;

aligning the sink basin on the countertop by employing the positioning template; and securing the sink basin to the countertop.

12. A method to position and mount a sink basin to a countertop, the method comprising:

presenting an apparatus having a framework, the framework having a positioning template and a routing template disposed within the framework;

placing the apparatus on a countertop;

removing a portion of the countertop by employing the routing template;

removing the routing template from the framework;

placing the sink basin on the countertop by employing the positioning template; and securing the sink basin to the countertop.

13. The method of claim 12 wherein placing the sink basin on the countertop by employing the positioning template includes using at least one clamp fixed to the positioning template to temporarily fix the sink basin to the countertop.

14. The method of claim 12, further comprising:

removing the apparatus from the countertop; and installing the countertop having the sink basin into a sink.

15. The apparatus of claim 1, wherein the positioning template includes a basin opening and at least one of a plurality of notches, a faucet clearance opening, and a plurality of clamps.

* * * * *